US005218845A

United States Patent [19]

Wang

[11] Patent Number: 5,218,845

[45] Date of Patent: Jun. 15, 1993

[54] CIRCULAR KNITTING MACHINE STRIPER CONTROL SYSTEM

[76] Inventor: Ping-Shin Wang, No. 22, Lane 21, San-Chung Rd., Nan-King Dist., Taipei, Taiwan

[21] Appl. No.: 986,500

[22] Filed: Dec. 7, 1992

[51] Int. Cl.[5] ..... D04B 15/58

[52] U.S. Cl. ..... 66/139; 66/133; 66/138

[58] Field of Search ..... 66/111, 125 R, 127, 66/131, 133, 134, 135, 138, 139, 140 R

[56] References Cited

U.S. PATENT DOCUMENTS

| | | | |
|---|---|---|---|
| 3,500,663 | 3/1970 | Schmidt | 66/139 |
| 4,137,732 | 2/1979 | Gostelow et al. | 66/125 R X |
| 4,404,821 | 9/1983 | Johnson et al. | 66/139 |
| 4,656,842 | 4/1987 | Sawazaki et al. | 66/139 |
| 4,793,160 | 12/1988 | Uhlir et al. | 66/138 X |
| 5,070,709 | 12/1991 | Güell | 66/140 R |

FOREIGN PATENT DOCUMENTS

| | | | |
|---|---|---|---|
| 2710044 | 9/1977 | Fed. Rep. of Germany | 66/139 |
| 2710045 | 9/1977 | Fed. Rep. of Germany | 66/140 R |
| 2802080 | 7/1979 | Fed. Rep. of Germany | 66/134 |
| 0039456 | 3/1985 | Japan | 66/139 |
| 2016530 | 9/1979 | United Kingdom | 66/131 |
| 2203172 | 10/1988 | United Kingdom | 66/134 |

*Primary Examiner*—Clifford D. Crowder
*Assistant Examiner*—John J. Calvert
*Attorney, Agent, or Firm*—Bacon & Thomas

[57] ABSTRACT

A circular knitting machine striper control system for controlling the operation of the stripers of a circular knitting machine in changing yarns for patterns automatically. The control system includes a controller carried on a rotary table, having a plurality of swinging plates respectively controlled by solenoids to drive striping fingers of either fixed striper in moving respective striping feeders to change yarns for patterns. A striping finger is not triggered by the respective swinging plate during the rotary motion of the rotary table as the respective solenoid does no work, when yarn changing operation is not needed.

5 Claims, 7 Drawing Sheets

CIRCULAR KNITTING MACHINE STRIPER CONTROL SYSTEM

BACKGROUND OF THE INVENTION

The present invention relates to control systems and relates more particularly to a control system controlling the operation of the stripers of a circular knitting machine in changing yarns for patterns automatically.

A circular knitting machine, as shown in FIG. 1, may be equipped with stripers and controlled by a striper control system to change colored yarns for making color-patterned fabrics. This striper control system is complicated in structure. As illustrated in FIG. 2, each striper is controlled by a respective control device which has four reciprocating rods respectively controlled by a computer control through a respective solenoid, to trigger a respective pressure plate in moving a respective striping feeder, thereby causing the respective striping feeder in changing a yarn. Because a striper is controlled by a respective control device, various control devices should be used in a circular knitting machine. Therefore, the striper control system of a circular knitting machine according to the prior art is complicated and expensive to install.

SUMMARY OF THE INVENTION

The present invention eliminates the aforesaid disadvantages. The present invention uses a single controller to control all the stripers of a circular knitting machine. The controller is carried on a rotary table, and the stripers are spaced around the rotary table on a fixed bedplate. The controller has a plurality of swinging plates respectively controlled by computer-controlled solenoids to drive striping fingers of either fixed striper in moving respective striping feeders to change yarns for patterns. A striping finger is not triggered by the respective swinging plate during the rotary motion of the rotary table as the respective solenoid does no work, when yarn changing operation is not needed. The aforesaid arrangement permits the stripers to be controlled by a single controller, and therefore the manufacturing cost of the striper control system is greatly reduced and its installation procedure is simplified.

DETAILED DESCRIPTION OF THE PREFERRED EMBODIMENT

Figure 1:
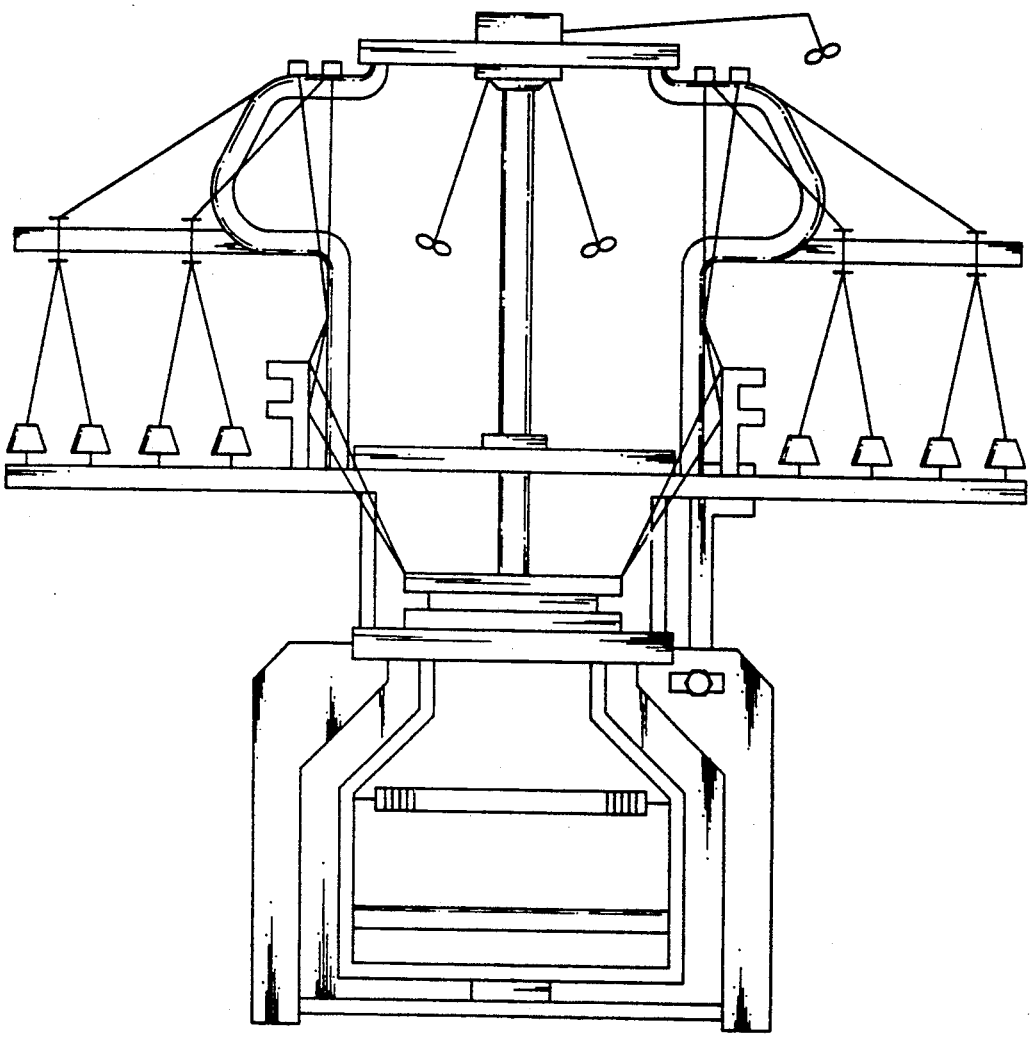
Fig. 1 PRIOR ART
FIG. 1 is a plan view showing the arrangement of a conventional circular knitting machine.
Figure 2:
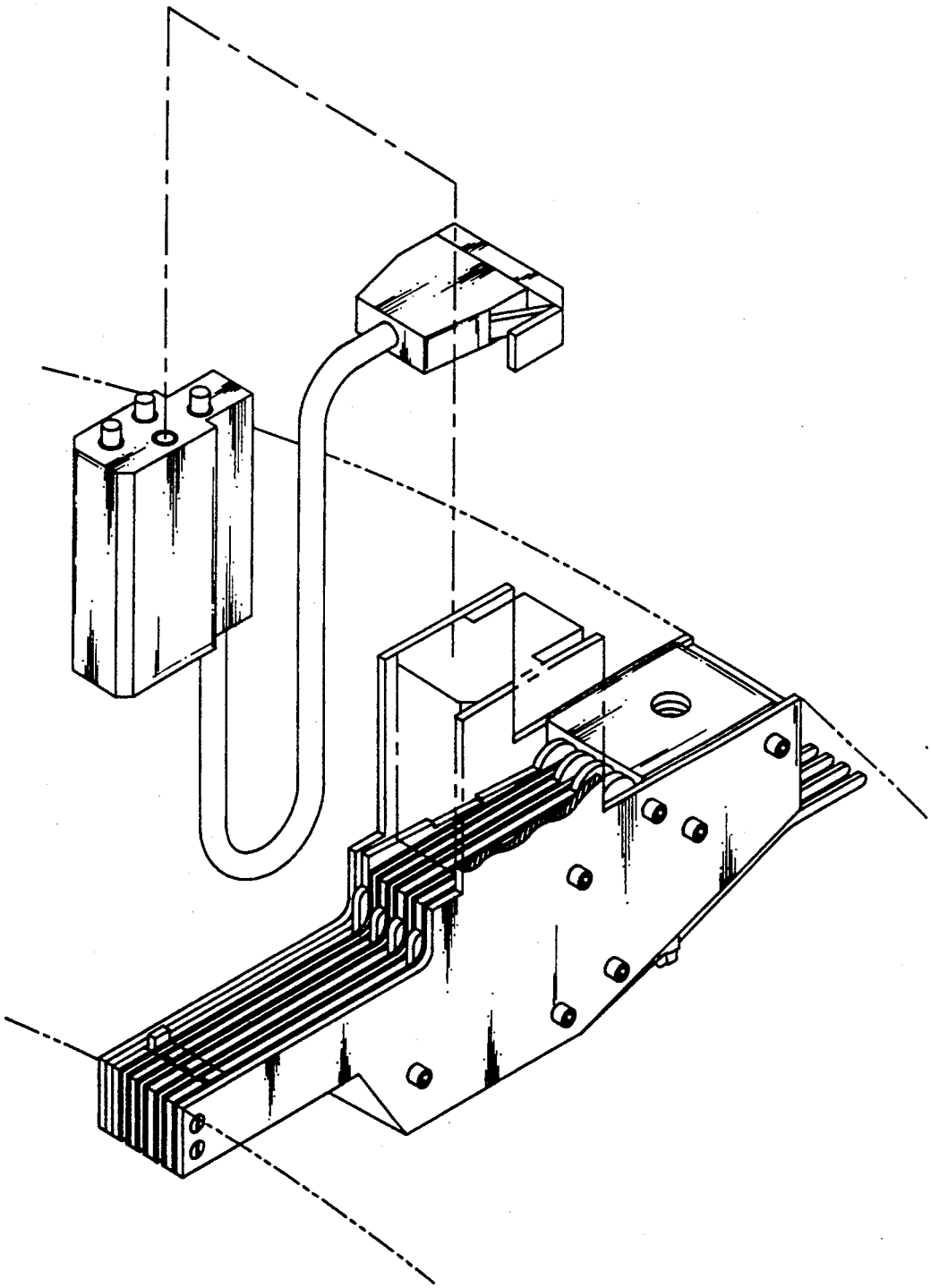
Fig.2 PRIOR ART
FIG. 2 is a partly exploded view of the circular knitting machine of FIG. 1 showing the relative arrangement of a striper and a control switch.
Figure 3:
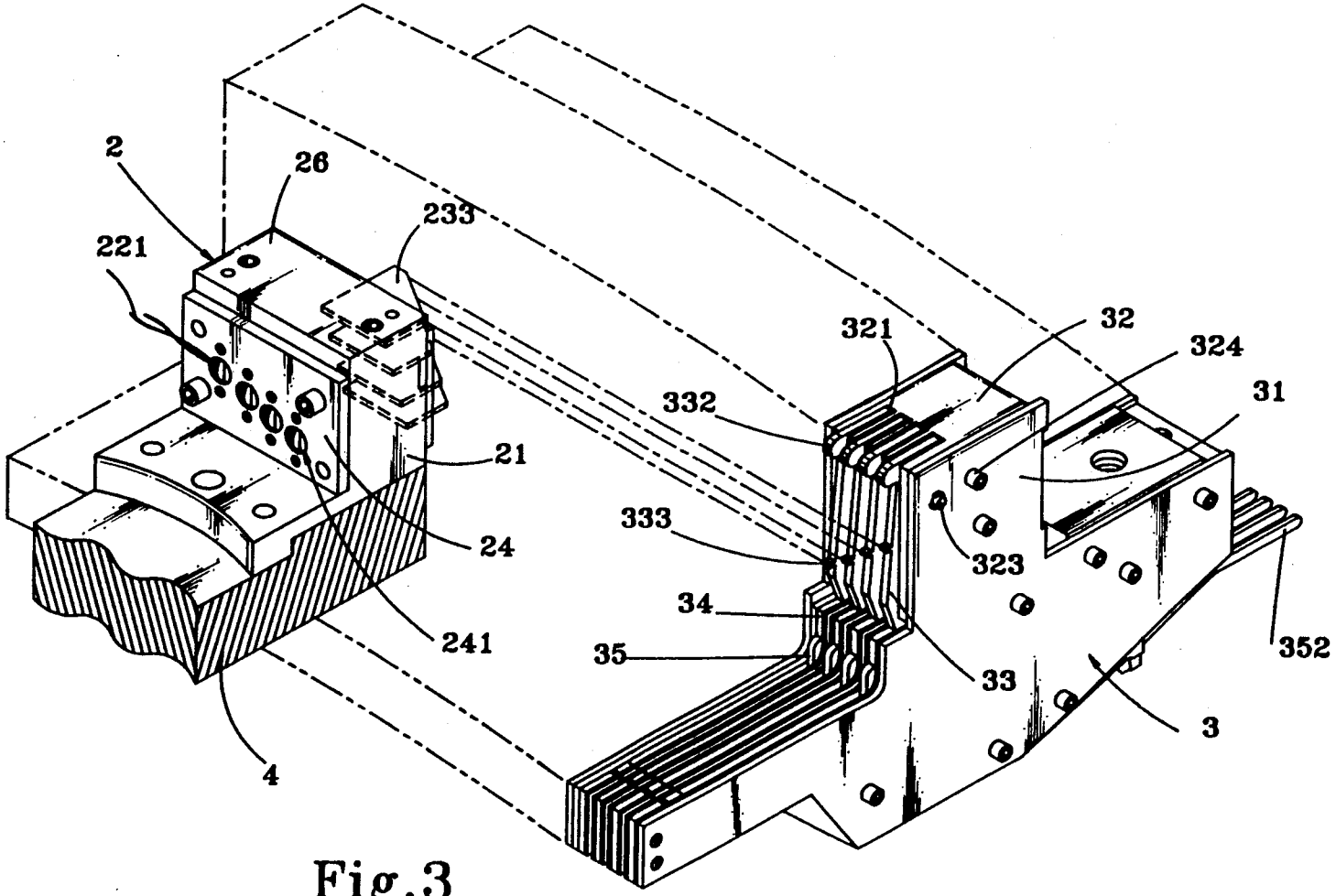
FIG. 3 is a perspective view of a circular knitting machine striper control system embodying the present invention.

Referring to FIG. 3, a circular knitting machine striper control system according to the present invention is comprised of a controller 2 fastened to the rotary table 4 of a circular knitting machine, and a plurality of stripers 3 spaced around the rotary table 4 and respectively controlled by the controller 2. The number of the stripers 3 may vary with the model of the knitting machine. A knitting machine may have as much as 48 stripers and controlled by a single controller 2.

Figure 4:
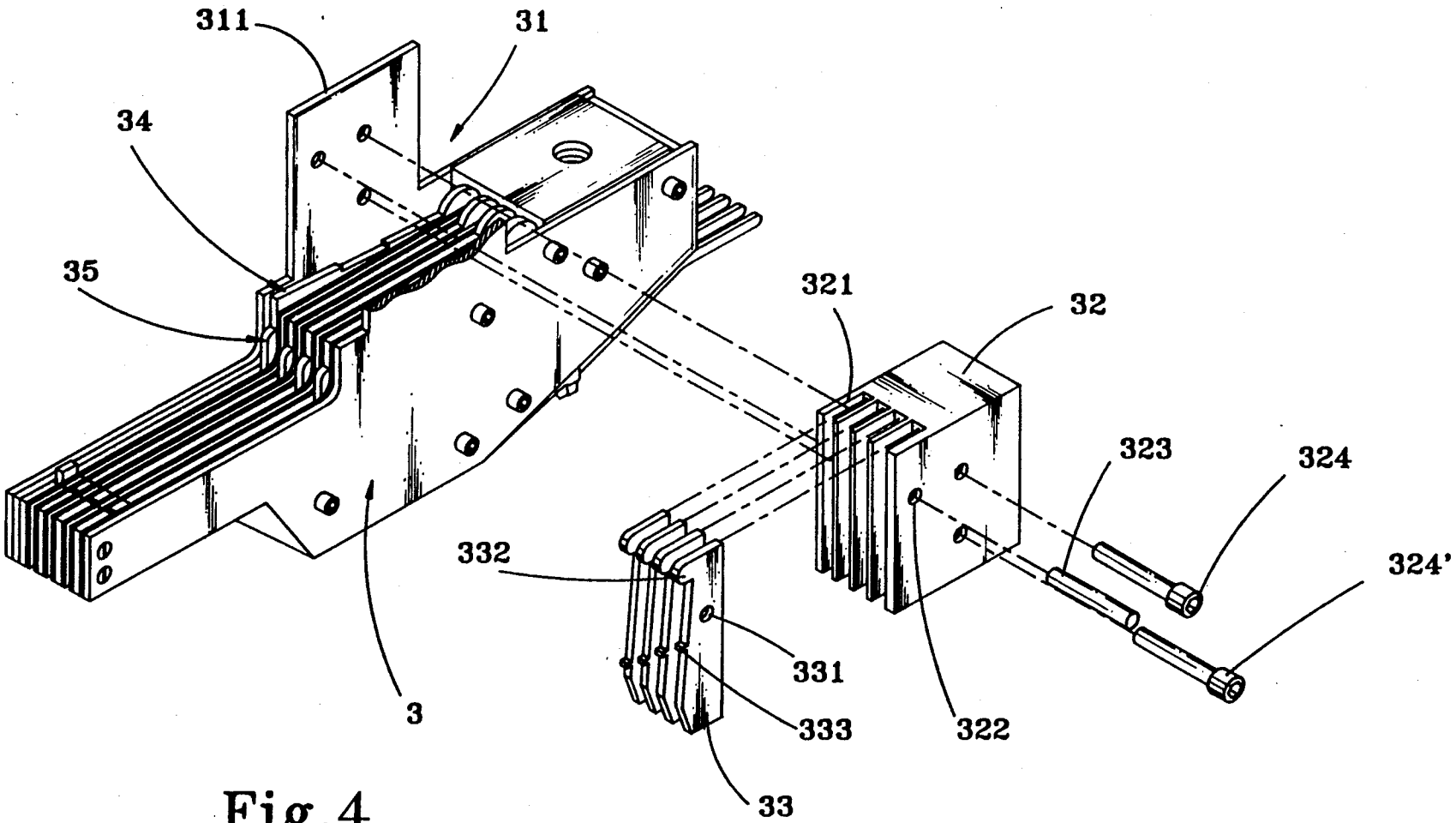
FIG. 4 is an exploded view of a striper of the circular knitting machine striper control system of FIG. 3.

Referring to FIG. 4, a striper 3 comprises a base plate 32 fastened within two side walls 311 of a head 31 by bolts 324, having a series of vertical slots 321 facing toward the rotary table 4 and an axle hole 322 through the vertical slots 321. The vertical slots 321 receive each a F-shaped striping finger 33 respectively. The F-shaped striping finger 33 has an axle hole 331 swingingly connected to the axle hole 322 on the base plate 32 within either vertical slot 321 by a pin 323, a top flange 332 and a stub rod 333 respectively projecting toward the rotary table at different heights. The location of the stub rod 333 on each F-shaped striping finger 33 is quite different. When assembled, the top flanges 322 of the F-shaped striping fingers 33 of the base plate 32 are disposed at the same elevation while the stub rods 333 rise one above another in proper order like a flight, and each F-shaped striping finger 33 is supported above a respective pressure plate 34 and a respective striping feeder 35.

Figure 5:
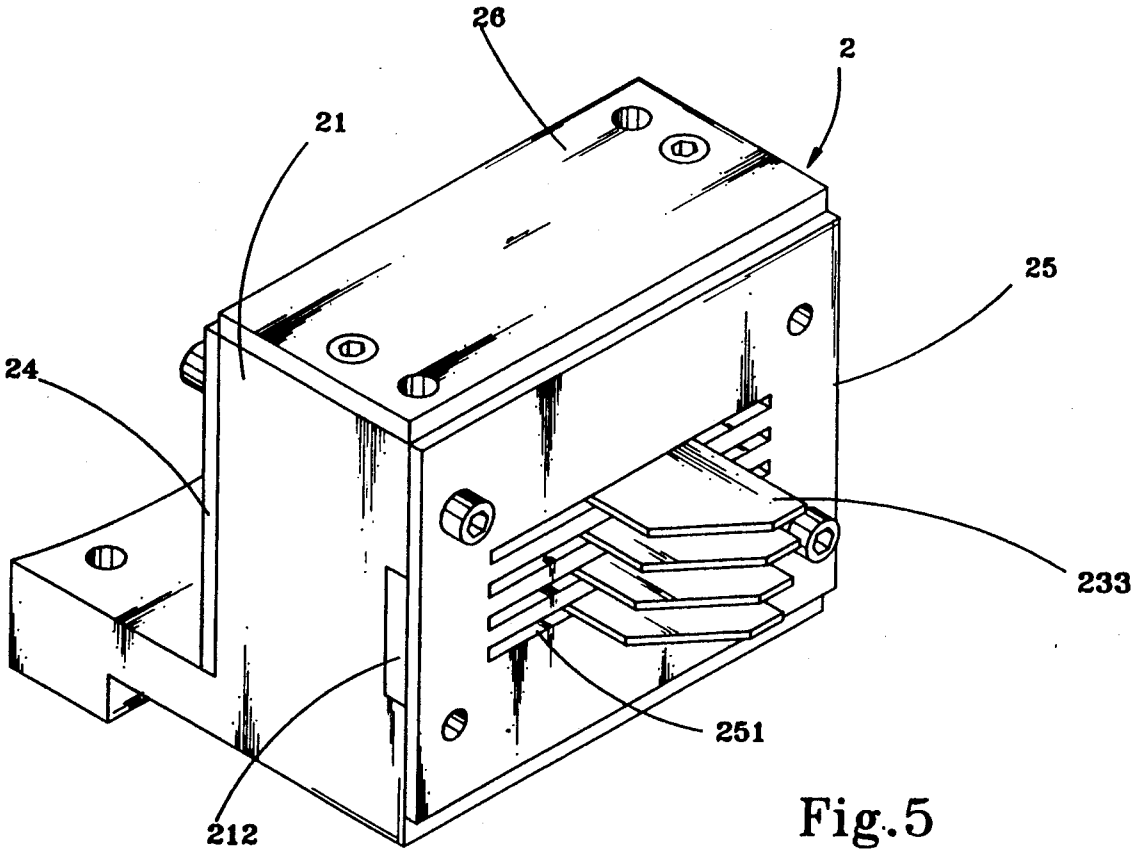
FIG. 5 is an elevational view of the controller of the circular knitting machine striper control system of FIG. 3.
Figure 6:
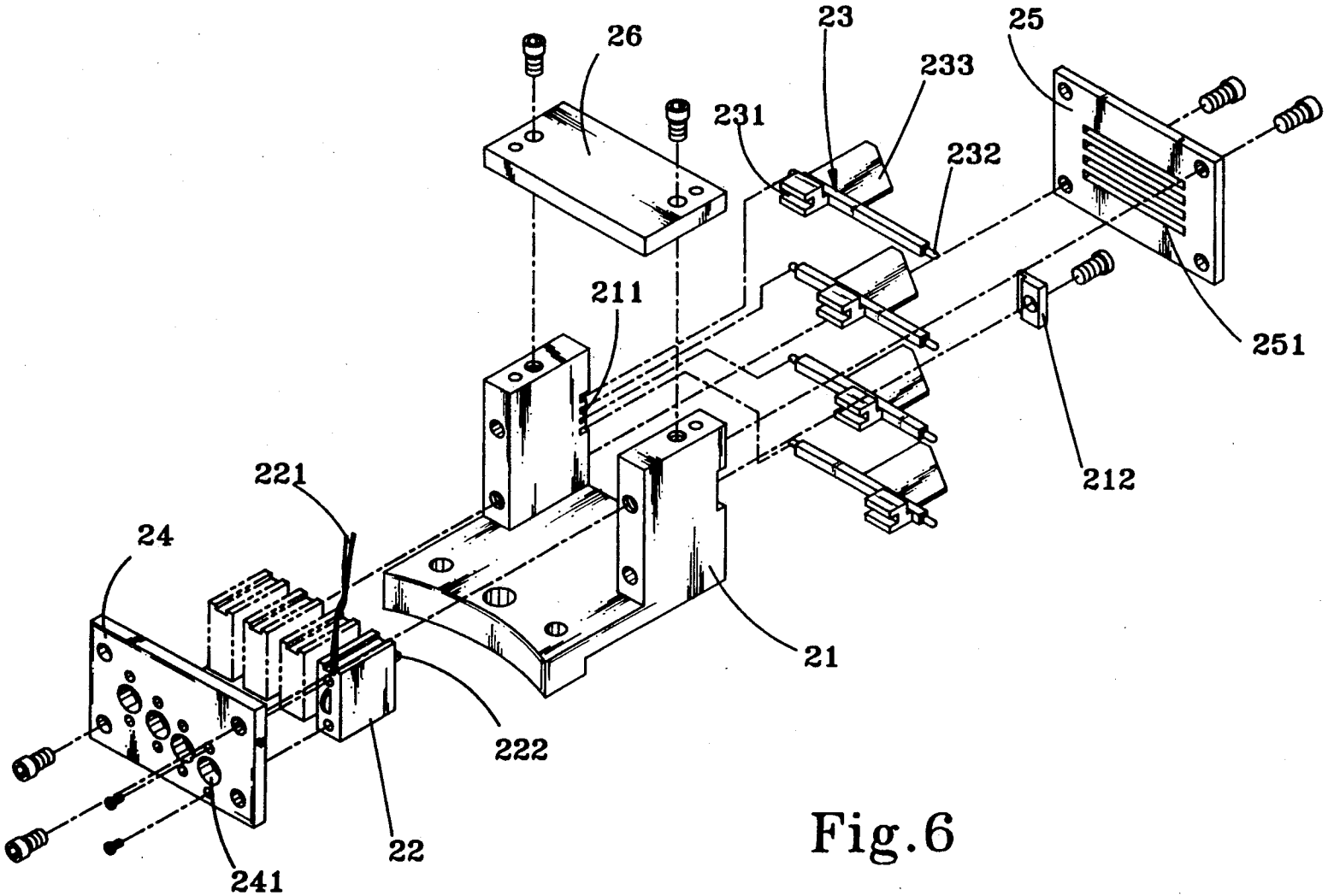
FIG. 6 is an exploded view of the controller of FIG. 5.

Referring to FIGS. 5 and 6, the controller 2 is generally comprised of a plurality of solenoids 22 fastened inside a casing 21 and covered by a front cover 24, a back cover 25 and a top cover 26, and a plurality of swinging plates 23 respectively controlled to swing by the solenoids 22. The front cover 24 has wire holes 241, through which conductors are inserted to electrically and respectively connect the solenoids 22 to an external computer system (not shown). Each solenoid 22 has a reciprocating rod 222 inserted in a locating groove 231 on either swinging plate 23 and controlled to alternatively move the respective swinging plate 23 back and forth. Each swinging plate 23 has two end rods 232 on two opposite ends thereof inserted in respective channels 211 on two opposite side walls of the casing 21 at the back side thereof and secured in place by locating plates 212, and a chamfered side wing 233 extended out of the back cover 25 through a respective slot 251. The side wing 233 of each swinging plate 23 may be disposed in contact with the stub rod 333 on the respective F-shaped striping finger 33 of either striper 3 or moved to pass horizontally through the gap between the two stub rods 333 of either two adjacent F-shaped striping fingers 33 of either striper 3 stopped (see FIG. 7), and therefore rotating the rotary table 4 causes the F-shaped striping fingers 33 of each striper 3 to be respectively driven by the swinging plates 23 to move the striping feeders 35 via the pressure plates 34 respectively, so as to further change yarns.

Figure 7:
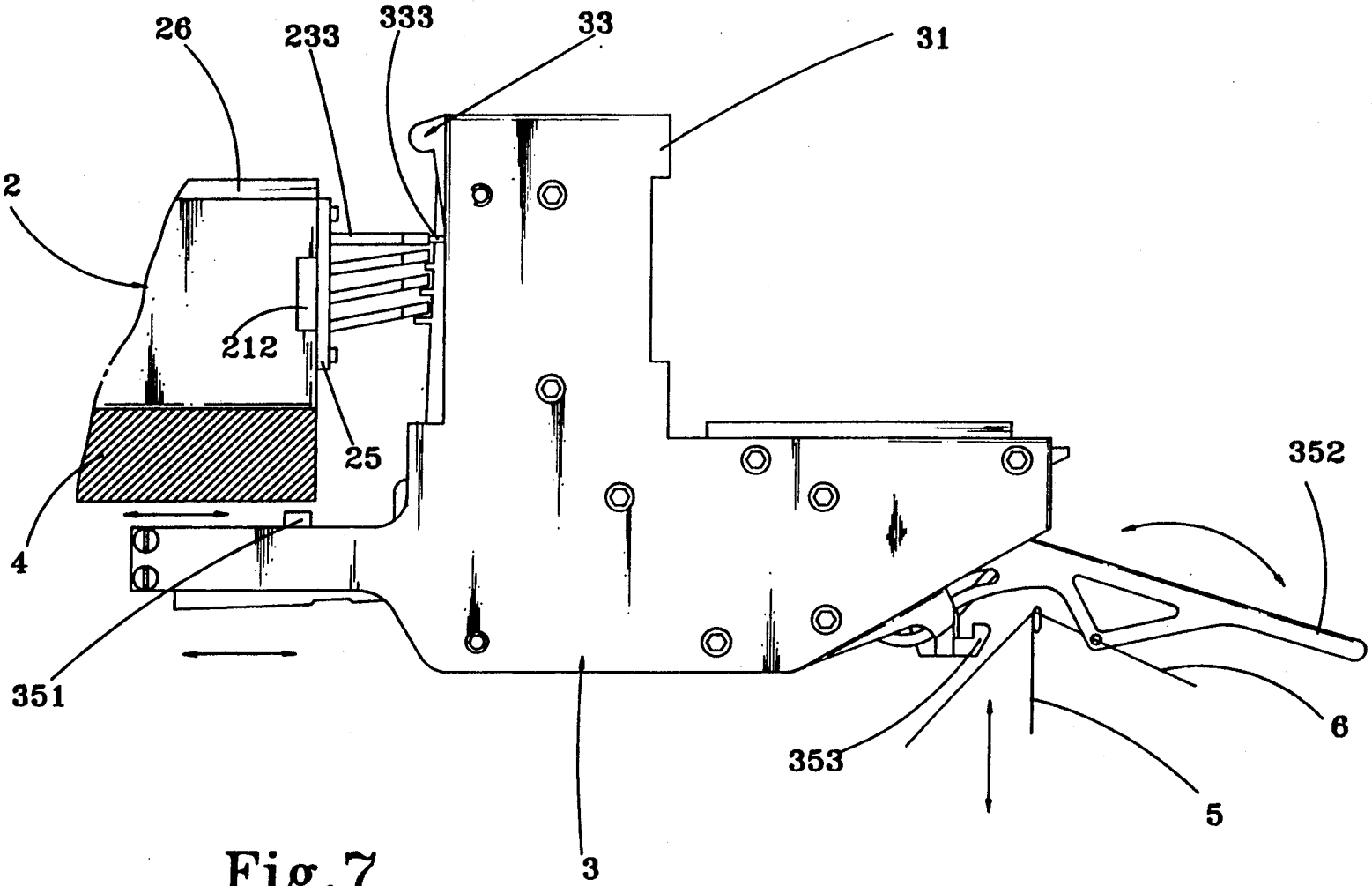
FIG. 7 is a front plan view of the circular knitting machine striper control system of FIG. 3, showing a striper driven by the controller to change a yarn.

Referring to FIG. 7, during the operation of the circular knitting machine, the solenoids 22 of the controller 2 are controlled by a computer system through a pre-edited control program. When a solenoid 22 is turned on, the respective reciprocating rod 222 is driven to move the the side wing 233 of the respective swinging plate 23 from the stub rod 333 of the respective F-shaped striping finger 33, and therefore the respective striping feeder 35 does no work. On the contrary, if a yarn is to be changed, the respective solenoid 22 of the controller 2 is off for permitting the side wing 233 of the respective swinging plate 23 to push the stub rod 333 of the respective F-shaped striping finger 33, hereby causing the respective pressure plate 34 to reciprocate the respective striping feeder 35 in changing a yarn. As the tail 352 of a striping feeder 35 is moved outwards, the selected yarn 6 is guided out for knitting by a respective needle 5 being reciprocated up and down or cutting by a cutter 353. Therefore, by means of the rotary motion of the rotary table 4 to carry the controller 2, the stripers 3 are driven by the controller 2 to proceed with yarn changing operation.

I claim:

1. A circular knitting machine striper control system comprising a plurality of stripers mounted on a bedplate spaced around a rotary table of a circular knitting machine, and a controller mounted on said rotary table and controlled by a computer control to drive said stripers in changing yarns for patterns, wherein each striper comprises a base plate fastened inside a head, having a plurality of F-shaped striping fingers respectively and swingingly fastened in a series of vertical slots thereof and controlled by said controller to drive a respective pressure plate in moving a striping feeder for yarn changing operation, said F-shaped striping fingers having a respective top flange projecting toward said rotary table and arranged at the same height and a respective stub rod projecting toward said rotary table and risen one above another; said controller comprises a plurality of solenoids, a plurality of swinging plates respectively driven by said solenoids to move the respective striping finger in driving the respective striping feeder for yarn changing operation, each swinging plate having a chamfered side wing carried to push the stub rod of the respective striping finger in driving the respective striping feeder for yarn changing operation.

2. The circular knitting machine striper control system of claim 1 wherein the number of the vertical slots and the striping fingers of each striper is equal to the number of colors of the yarns to be knitted by the circular knitting machine.

3. The circular knitting machine striper control system of claim 1 wherein a horizontal gap is respectively maintained between either two adjacent stub rods for passing the chamfered side wing of the respective swinging plate.

4. The circular knitting machine striper control system of claim 1 wherein the side wing of either swinging plate is carried by said rotary table to push the stub rod of the respective striping finger a the respective solenoid does no work.

5. The circular knitting machine striper control system of claim 1 wherein the side wing of either swinging plate is carried by said rotary table to pass through the respective horizontal gap between two adjacent stub rods as the respective solenoid does work when yarn changing operation is not needed.

* * * * *